US006685302B2

(12) United States Patent
Haluzak et al.

(10) Patent No.: US 6,685,302 B2
(45) Date of Patent: Feb. 3, 2004

(54) FLEXTENSIONAL TRANSDUCER AND METHOD OF FORMING A FLEXTENSIONAL TRANSDUCER

(75) Inventors: Charles Craig Haluzak, Corvallis, OR (US); Timothy E Beerling, Berkeley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/060,461

(22) Filed: Jan. 30, 2002

(65) Prior Publication Data

US 2003/0142170 A1 Jul. 31, 2003

Related U.S. Application Data

(63) Continuation-in-part of application No. 10/003,600, filed on Oct. 31, 2001.

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700 T; 310/328–330; 29/890.1

(56) References Cited

U.S. PATENT DOCUMENTS

| | | | |
|---|---|---|---|
| 4,533,082 | A | 8/1985 | Maehara et al. |
| 4,574,327 | A | 3/1986 | Wilner |
| 4,605,167 | A | 8/1986 | Maehara |
| 4,894,664 | A | 1/1990 | Tsung Pan |
| 5,110,712 | A | 5/1992 | Kessler et al. |
| 5,152,456 | A | 10/1992 | Ross et al. |
| 5,255,016 | A | 10/1993 | Usui et al. |
| 5,387,314 | A | 2/1995 | Baughman et al. |
| 5,513,431 | A | 5/1996 | Ohno et al. |
| 5,518,179 | A | 5/1996 | Humberstone et al. |
| 5,716,533 | A | 2/1998 | O'Neill et al. |
| 5,828,394 | A | 10/1998 | Khuri-Yakub et al. |
| 5,870,123 | A | 2/1999 | Lorenze, Jr. et al. |
| 5,876,497 | A | 3/1999 | Atoji |
| 5,938,117 | A | 8/1999 | Ivri |
| 6,000,787 | A | 12/1999 | Weber et al. |
| 6,010,461 | A | 1/2000 | Haniff et al. |
| 6,045,710 | A | 4/2000 | Silverbrook |
| 6,234,608 | B1 | 5/2001 | Genovese et al. |
| 6,291,927 | B1 | 9/2001 | Percin et al. |

FOREIGN PATENT DOCUMENTS

| | | |
|---|---|---|
| EP | 0049636 B1 | 5/1985 |
| EP | 0655334 A1 | 5/1995 |
| EP | 1075949 A2 | 2/2001 |
| WO | WO 93/01404 | 1/1993 |
| WO | WO 93/10910 | 6/1993 |
| WO | WO 97/12689 | 4/1997 |
| WO | WO 01/62394 | 8/2001 |

OTHER PUBLICATIONS

Percin et al., Micromachined 2–D Array Piezoelectrically Actuated Flextensional Transducers: New Designs. Part of the SPIE Conference on Micromachined Devices and Components IV, Santa Clara, California, Sep. 1998; SPIE vol. 3514, pp. 411–414.

(List continued on next page.)

*Primary Examiner*—Raquel Yvette Gordon

(57) ABSTRACT

A flextensional transducer includes a substrate having an etch stop layer interposed between a first layer and a second layer, a flexible membrane supported by the second layer of the substrate and having an orifice defined therein, and an actuator provided on the flexible membrane and adapted to deflect the flexible membrane. The substrate has an opening formed through the first layer and a hole formed through the etch stop layer and the second layer such that the hole through the etch stop layer and the second layer of the substrate communicates with the opening through the first layer of the substrate and the orifice in the flexible membrane.

35 Claims, 7 Drawing Sheets

OTHER PUBLICATIONS

Percin et al., Controlled Ink–Jet Printing and Deposition of Organic Polymers and Solid Particles. Applied Physics Letters, vol. 73, No. 16, Oct. 19, 1998, pp. 2375–2377.

Percin et al., Micromachined Two–Dimensional Array Piezoelectrically Actuated Transducers. Applied Physics Letters, vol. 72, No. 11, Mar. 16, 1998, pp. 1397–1399.

Percin et al., Micromachined 2–D Array Piezoelectrically Actuated Flextensional Transducers and Inkjet Print Heads. Electrochemical Society Proceedings vol. 98–14, pp. 87–93.

Percin et al., Resist Deposition without Spinning by Using Novel Inkjet Technology and Direct Lithography for MEMS. SPIE vol. 3333, pp. 1382–1389.

Percin, G., Micromachined Piezoelectrically Actuated Flextensional Transducers for High Resolution Printing and Medical Imaging, 1999, pp. 1–23.

Percin et al., Piezoelectrically Acuated Transducer and Droplet Ejector. 1996 IEEE Ultrasonics Symposium, pp. 913–916.

Percin et al., Piezoelectrically Acuated Droplet Ejector. Review of Scientific Instruments, vol. 68, No. 12, Dec. 1997, pp. 4561–4563.

Percin et al., Micromachined 2–D Array Piezoelectrically Actuated Flextensional Transducers. 1997 IEEE Ultrasonics Symposium, pp. 959–962.

Maehara et al., Optimum Design Procedure for Multi–Pinhole–Plate Ultrasonic Atomizer. Japanese Journal of Applied Physics, vol. 26, Supplement 26–1, 1987, pp. 215–217.

Ueha et al., Mechanism of Ultrasonic Atomization Using a Multi–Pinhole Plate. Journal of the Acoustical Society of Japan (E), vol. 6, No. 1, Jan. 1985, pp. 21–26.

Maehara et al., A Pinhole–Plate Ultrasonic Atomizer. Ultrasonics, Nov. 1984, pp. 259–260.

Chien–Hua Chen et al., U.S. Patent Application: "Fluid Ejection Device With a Composite Substrate", Serial No. 10/003,600, Filed Oct. 31, 2001, pp 1–23.

FLEXTENSIONAL TRANSDUCER AND METHOD OF FORMING A FLEXTENSIONAL TRANSDUCER

CROSS-REFERENCE TO RELATED APPLICATIONS

This application is a Continuation-in-Part of U.S. patent application Ser. No. 10/003,600, entitled "Fluid Ejection Device with a Composite Substrate" filed on Oct. 31, 2001, assigned to the assignee of the present invention, and incorporated herein by reference.

THE FIELD OF THE INVENTION

The present invention relates generally to flextensional transducers, and more particularly to a substrate for a flextensional transducer.

BACKGROUND OF THE INVENTION

Fluid drop ejectors have been developed for ejecting droplets of a flowable material. An example of a fluid drop ejector includes a flextensional transducer. As illustrated in FIGS. 1A and 1B, a conventional flextensional transducer 90 includes a body or substrate 92, a flexible membrane 94 having an orifice 96 defined therein, and an actuator 98. The substrate defines a reservoir for holding a supply of flowable material and the flexible membrane has a circumferential edge supported by the substrate. The actuator includes a piezoelectric material which deforms when an electrical voltage is applied. As such, when the piezoelectric material deforms, the flexible membrane deflects causing a quantity of flowable material to be ejected from the reservoir through the orifice.

One application of a flextensional transducer is in an inkjet printing system. As such, the inkjet printing system includes a printhead having a plurality of flextensional transducers that eject droplets of ink through orifices or nozzles to form an image on a print medium. Fluid or ink is delivered to each of the flextensional transducers through fluid channels formed in a substrate of the flextensional transducers. Existing methods for forming fluid channels in the substrate, however, are relatively slow and expensive, are difficult to control, and/or expose materials which are reactive with ink.

Accordingly, there is a desire for accurately and efficiently forming a substrate for a flextensional transducer.

SUMMARY OF THE INVENTION

One aspect of the present invention provides a flextensional transducer. The flextensional transducer includes a substrate having an etch stop layer interposed between a first layer and a second layer, a flexible membrane supported by the second layer of the substrate and having an orifice defined therein, and an actuator provided on the flexible membrane and adapted to deflect the flexible membrane. The substrate has an opening formed through the first layer and a hole formed through the etch stop layer and the second layer such that the hole through the etch stop layer and the second layer of the substrate communicates with the opening through the first layer of the substrate and the orifice in the flexible membrane.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1A:
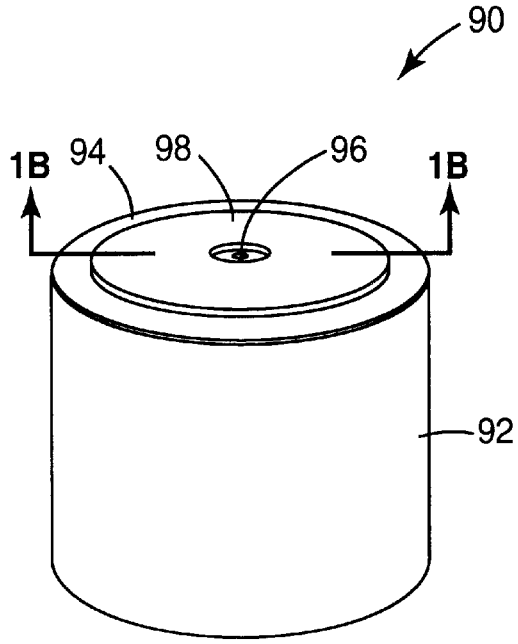
Fig. 1A PRIOR ART
FIG. 1A is a perspective view of a portion of a prior art flextensional transducer.
Figure 1B:
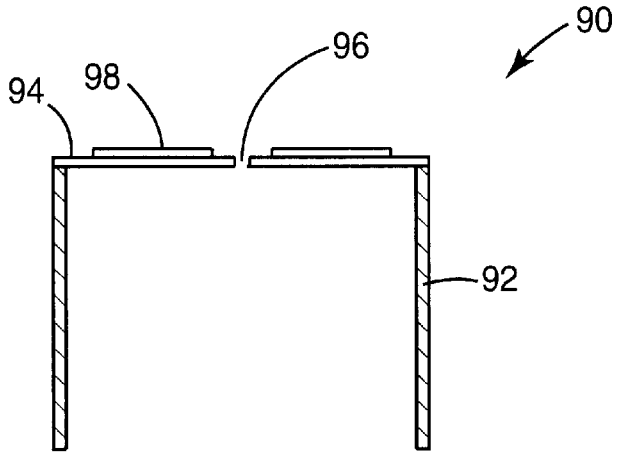
Fig. 1B PRIOR ART
FIG. 1B is a cross-sectional view taken along line 1B—1B of FIG. 1A.
Figure 2A:
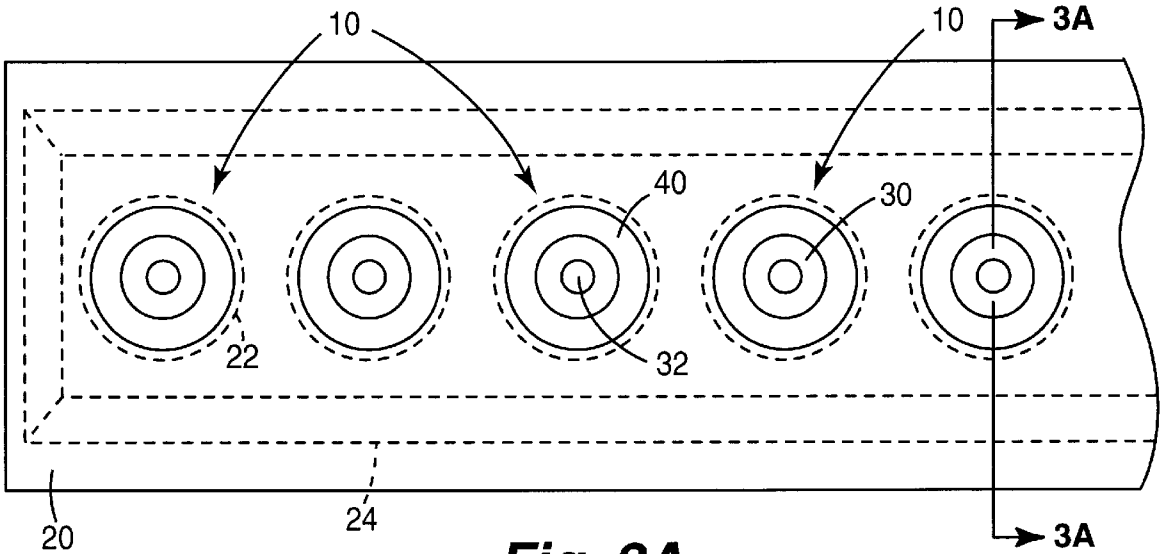
FIG. 2A is a schematic top view illustrating one embodiment of a plurality of flextensional transducers according to the present invention.
Figure 2B:
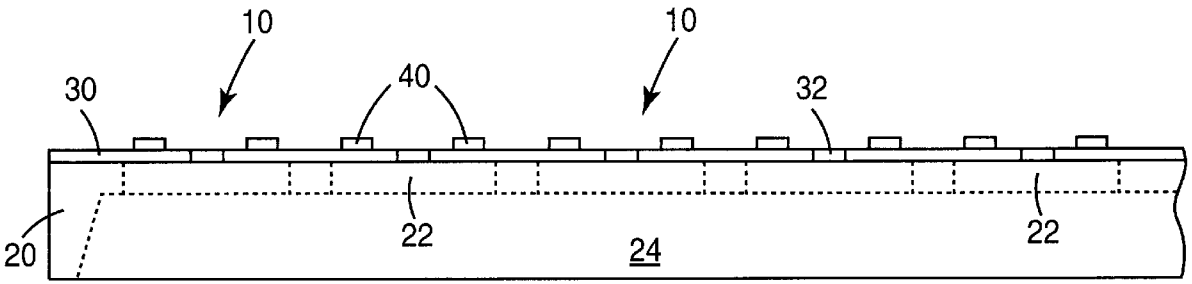
FIG. 2B is a schematic side view illustrating one embodiment of the plurality of flextensional transducers of FIG. 2A.

FIGS. 2A and 2B illustrate one embodiment of a plurality of flextensional transducers 10 arranged to form an array of flextensional transducers 10. Each flextensional transducer 10 is a fluid drop ejection device capable of ejecting droplets of a flowable material. Each flextensional transducer 10 may include drop-on-demand and/or continuous modes of operation. For clarity, the following description refers to the ejection of fluid from flextensional transducers 10. Fluid, as used herein, is defined to include any flowable material, including a liquid such as water, ink, blood, or photoresist and flowable particles of a solid such as talcum powder.

In one embodiment, each flextensional transducer 10 includes a supporting structure or substrate 20, a flexible membrane 30, and an actuator 40. While the plurality of flextensional transducers 10 are illustrated as being formed with a single substrate, it is understood that flextensional transducers 10 may be formed separately from each other with distinct substrates.

In one embodiment, substrate 20 has a plurality of fluid cavities 22 formed therein which communicate with a supply of fluid for flextensional transducers 10. When a plurality of flextensional transducers 10 are formed with a single substrate, substrate 20 has a fluid manifold or plenum 24 formed therein which distributes fluid to each flextensional transducer 10 and, more specifically, each fluid cavity 22 of a respective flextensional transducer 10. Preferably, each fluid cavity 22 is cylindrical in shape with an inlet of each fluid cavity 22 communicating with fluid plenum 24.

By forming flextensional transducers 10 with separate and distinct fluid cavities 22, fluidic cross-talk between fluid cavities 22 is avoided. While substrate 20 is illustrated as having an exterior profile which is rectangular in shape, it is understood that the exterior profile of substrate 20 may be other shapes such as round or square.

Figure 3A:
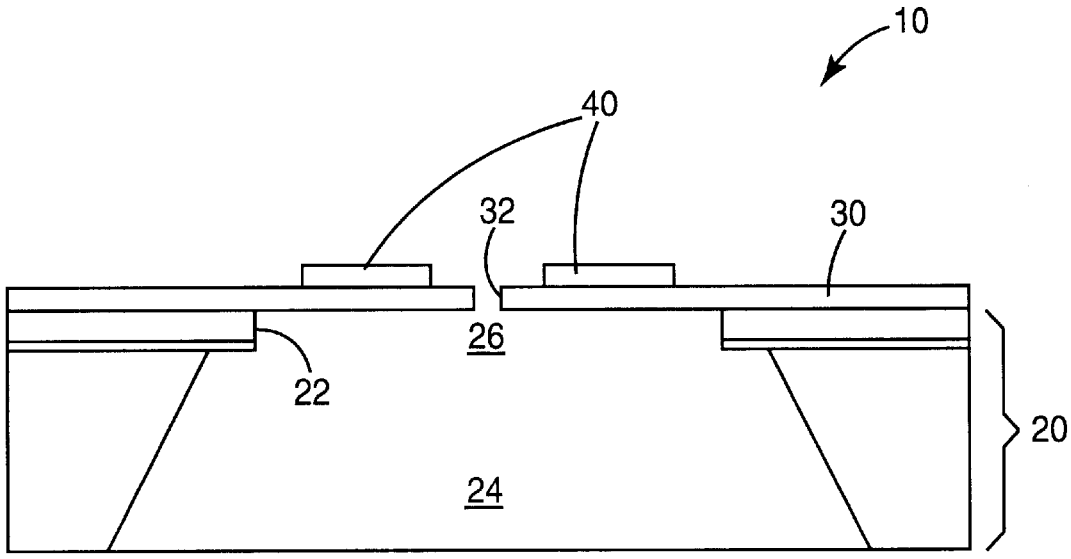
FIG. 3A is a schematic cross-sectional view from the perspective of line 3A—3A of FIG. 2A illustrating one embodiment of a flextensional transducer according to the present invention.

As illustrated in the embodiment of FIG. 3A, flexible membrane 30 is supported by substrate 20 and extends across or over fluid cavity 22 such that fluid cavity 22 and flexible membrane 30 define a fluid reservoir 26. As such, fluid reservoir 26 holds or contains fluid for flextensional transducer 10. As described below, deflection of flexible membrane 30 causes ejection of fluid from fluid reservoir 26.

Flexible membrane 30 has an orifice 32 defined therein which communicates with fluid cavity 22 and, more specifically, fluid reservoir 26. As such, when fluid cavity 22 is supplied with fluid, the fluid communicates with orifice 32. Orifice 32 defines a nozzle for ejecting a quantity of fluid from fluid cavity 22 in response to deflection of flexible membrane 30. Flexible membrane 30 is supported by substrate 20 such that a maximum deflection of flexible membrane 30 occurs at orifice 32 during a symmetric deflection mode. While flexible membrane 30 is illustrated as having one orifice 32, it is within the scope of the present invention for flexible membrane 30 to have one or more orifices 32 defined therein.

Flexible membrane 30 is formed of a flexible material such as, for example, a flexible thin film of silicon nitride or silicon carbide or flexible thin layer of silicon, as described below. In one embodiment, substrate 20 and flexible membrane 30 are formed of a homogenous material such as, for example, silicon. As such, flexible membrane 30 is formed by a flexible thin layer of silicon extending across fluid cavity 22.

Actuator 40 is associated with and causes deflection of flexible membrane 30. In the embodiment shown in FIG. 2A, actuator 40 is annular in shape and positioned symmetrically and, more specifically, concentrically with orifice 32. In another embodiment, actuator 40 is discontinuous, having multiple uncoupled sections positioned about orifice 32.

While fluid cavity 22, flexible membrane 30, and actuator 40 are illustrated as being circular in shape, it is within the scope of the present invention for fluid cavity 22, flexible membrane 30, and/or actuator 40 to be of other shapes such as square or rectangular with flexible membrane 30 being supported by substrate 20 on less than all sides.

In one embodiment, actuator 40 is provided and, more specifically, as described below, formed on a side of flexible membrane 30 opposite fluid cavity 22. As such, actuator 40 is not in direct contact with fluid contained within fluid cavity 22. Thus, any potential effects of fluid contacting actuator 40, such as corrosion or electrical shorting, are reduced. In one embodiment, there is a passivation layer over electrodes for the actuator (although not shown in the drawings) that would substantially protect the electrodes from the environment, including mechanical and chemical (ink) affects. While actuator 40 is illustrated as being provided on a side of flexible membrane 30 opposite fluid cavity 22, it is also within the scope of the present invention for actuator 40 to be provided on a side of flexible membrane 30 facing fluid cavity 22.

In one embodiment, actuator 40 includes a piezoelectric material which changes shape, for example, expands and/or contracts, in response to an electrical signal. Thus, in response to the electrical signal, actuator 40 applies a force to flexible membrane 30 which causes flexible membrane 30 to deflect. As such, orifice 32 is located in an area of flexible membrane 30 which achieves maximum deflection when flexible membrane 30 deflects. Examples of a piezoelectric material include zinc oxide or a piezoceramic material such as barium titanate, lead zirconium titanate (PZT), or lead lanthanum zirconium titanate (PLZT). It is understood that actuator 40 may include any type of device which causes movement or deflection of flexible membrane 30 including an electrostatic, magnetostatic, and/or thermal expansion actuator.

Figure 3B:
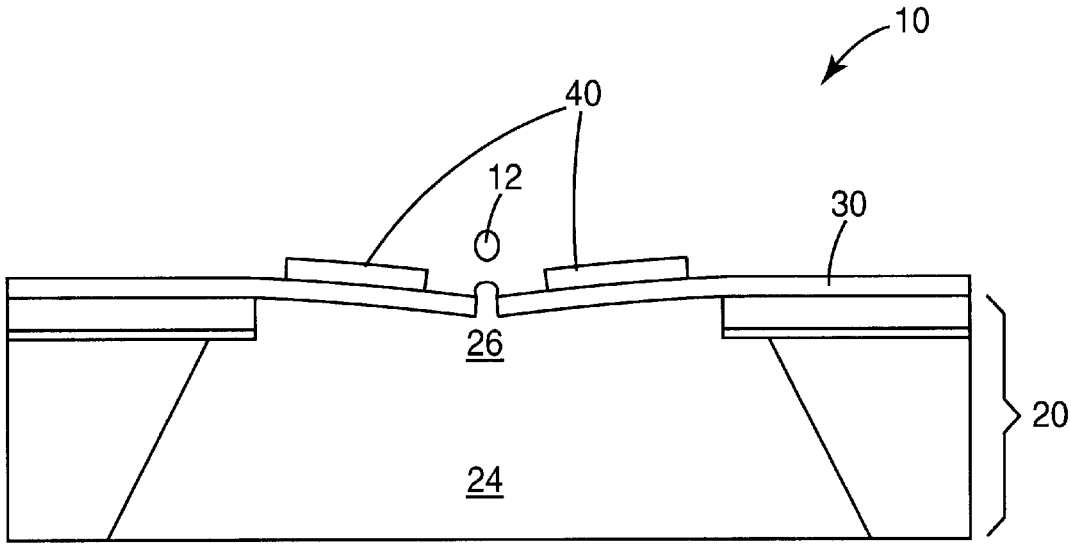
FIG. 3B is a schematic cross-sectional view similar to FIG. 3A illustrating ejection of fluid from the flextensional transducer of FIG. 3A.

As illustrated in the embodiment of FIG. 3B, when flexible membrane 30 deflects, a droplet 12 of fluid is formed and ejected from orifice 32 of flextensional transducer 10. Since flexible membrane 30 is supported about a periphery thereof, the largest deflection of flexible membrane 30 occurs at or near orifice 32. It is understood that the extent of deflection of flexible membrane 30 illustrated in the embodiment of FIG. 3B has been exaggerated for clarity of the invention.

Cyclical application of an electrical signal to actuator 40 causes flexible membrane 30 to oscillate. Flexible membrane 30 has multiple resonant frequencies and, as such, may oscillate in different resonant vibrational modes. Preferably, flexible membrane 30 oscillates into a lowest order, symmetric resonant vibrational mode with maximum deflection occurring at orifice 32. Flextensional transducer 10, therefore, ejects droplets 12 of fluid at a predetermined rate and/or at predetermined intervals.

FIGS. 4A–4H illustrate one embodiment of forming flextensional transducer 10. While only one flextensional transducer 10 is illustrated as being formed, it is understood that multiple flextensional transducers 10 may be formed at the same time.

Figure 4A:
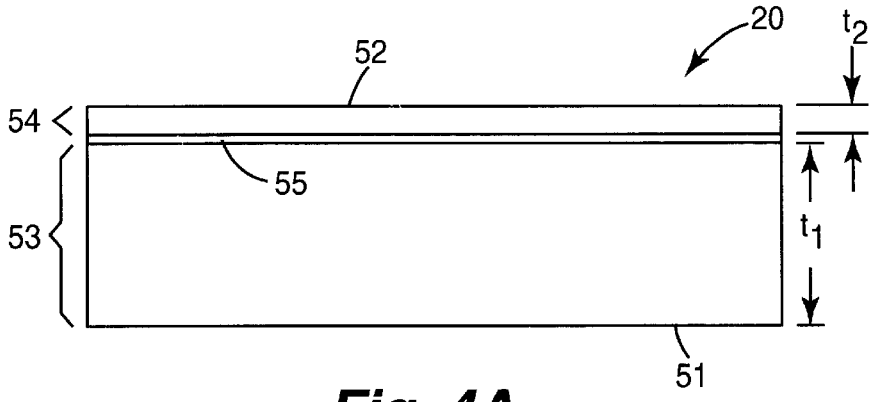
FIGS. 4A–4H illustrate one embodiment of forming a flextensional transducer according to the present invention.

As illustrated in the embodiment of FIG. 4A, substrate 20 has a first side 51 and a second side 52 opposite first side 51. In addition, substrate 20 includes a first layer 53, a second layer 54, and a third layer 55. Third layer 55 is interposed between first layer 53 and second layer 54 such that first layer 53 defines first side 51 of substrate 20 and second layer 54 defines second side 52 of substrate 20. Preferably, first layer 53 has a thickness t1 and second layer 54 has a thickness t2 such that thickness t1 of first layer 53 is greater than thickness t2 of second layer 54. In one illustrative embodiment, thickness t1 of first layer 53 is approximately 660 microns and thickness t2 of second layer 54 is approximately 10 microns. It is understood, however, that other possible ranges of thickness t1 and/or thickness t2 are within the scope of the present invention.

In one embodiment, substrate 20 is a silicon substrate such that first layer 53 and second layer 54 are each silicon layers and third layer 55 forms a boundary between first layer 53 and second layer 54. More specifically, third layer 55 forms an etch stop between first layer 53 and second layer 54. As such, third layer 55 forms an etch stop layer which is resistant to at least one particular type of etchant used on substrate 20, as described below.

In one embodiment, substrate 20 is a silicon-on-insulator (SOI) wafer. An SOI wafer includes an oxide layer interposed or buried between two silicon layers. The oxide layer is resistant to at least one particular type of etchant used on substrate 20 and may include, for example, silicon dioxide ($SiO_2$) or field oxide (FOX). As such, the silicon layers of the SOI wafer form first layer 53 and second layer 54, and the oxide layer of the SOI wafer forms third layer 55. Thus, the oxide layer of the SOI wafer forms the etch stop layer.

In another embodiment, substrate 20 is a unitary silicon substrate with third layer 55 being formed in the silicon substrate by boron doping. Boron doping or p++ doping, as is well known in the art, uses a boron source to diffuse dopants into a silicon substrate at a predetermined depth and create a boron doped layer. As such, the boron doped layer forms the etch stop layer and demarcates first layer 53 and second layer 54. In another embodiment, third layer 55 is formed by phosphorous doping or n-well doping, as is also well known in the art. As such, the phosphorous doped layer forms the etch stop layer and demarcates first layer 53 and second layer 54.

Figure 4B:
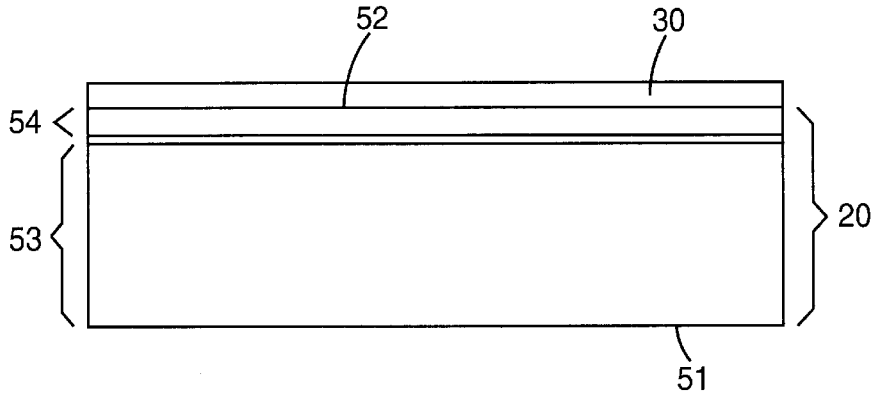

Next, as illustrated in the embodiment of FIG. 4B, flexible membrane 30 is formed on substrate 20. More specifically, flexible membrane 30 is formed on second layer 54 of substrate 20 along second side 52. Flexible membrane 30 is formed, for example, as a flexible thin film of silicon nitride or silicon carbide or flexible thin layer of silicon.

Figure 4C:
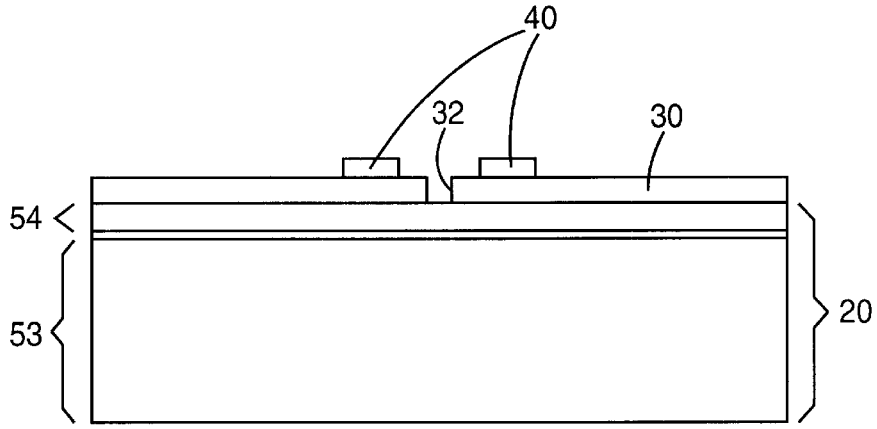

Next, as illustrated in the embodiment of FIG. 4C, actuator 40 is formed on flexible membrane 30 and nozzle or orifice 32 is formed in flexible membrane 30. In one embodiment, actuator 40 is formed by deposition on flexible membrane 30. In one embodiment, actuator 40 includes a piezoelectric material such as zinc oxide (ZnO) or a piezoceramic material such as barium titanate, lead zirconium titanate (PZT), or lead lanthanum zirconium titanate (PLZT). Actuator 40 may include one or more layers of material and may be formed by vapor deposition, sputtering, electron beam evaporation, and/or other deposition techniques. Orifice 32 is formed in flexible membrane 30 by, for example, etching through flexible membrane 30 to second layer 54 of substrate 20. Actuator 40 and orifice 32 are patterned, for example, by selectively masking flexible membrane 30.

Figure 4D:
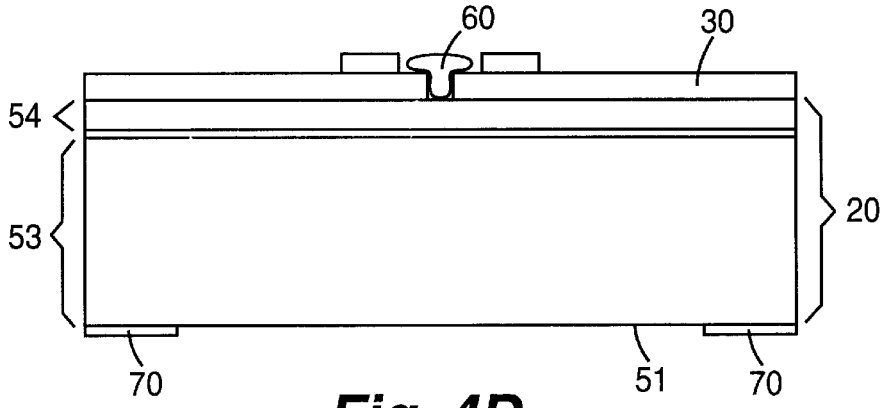

Next, as illustrated in the embodiment of FIG. 4D, a protective layer or cap 60 is formed in orifice 32 and a masking layer 70 is formed on substrate 20. Protective cap 60 protects orifice 32 as well as the exposed silicon of second layer 54 in the region of orifice 32. Preferably, protective cap 60 is formed of a material which is resistant to etchant used for etching of substrate 20, as described below. Protective cap 60 may be formed, for example, of silicon dioxide ($SiO_2$), silicon nitride, silicon carbide, and/or silicon oxynitride. Protective cap 60 may also be formed of tetraethylorthosilicate (TEOS). Protective cap 60 may be formed, for example, by chemical vapor deposition (CVD) including, more specifically, plasma enhanced chemical vapor deposition (PECVD).

Masking layer 70 is used to selectively control or block etching of first layer 53. As such, masking layer 70 is formed along first side 51 of substrate 20 and patterned to define where first layer 53 is to be etched to form fluid plenum 24 (FIG. 3A). It is understood that masking layer 70 may include one or more layers formed on first side 51.

In one embodiment, masking layer 70 is formed by deposition and patterned by photolithography and etching to define an exposed portion of first side 51 and outline an opening to be formed through first layer 53. Masking layer 70 is formed of a material which is resistant to etchant used for etching of first layer 53, as described below. Examples of a material suitable for masking layer 70 include silicon dioxide or silicon nitride.

Figure 4E:
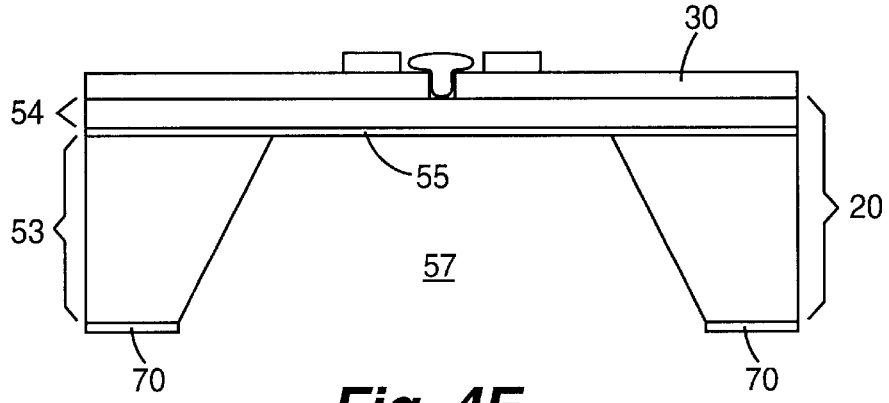

Next, as illustrated in the embodiment of FIG. 4E, a trench or opening 57 is formed in first layer 53 of substrate 20. More specifically, opening 57 is formed through first layer 53 from first side 51 to third layer 55. In one embodiment, opening 57 is formed in first layer 53 by etching first layer 53 from first side 51 to third layer 55. Preferably, opening 57 is formed using an anisotropic etch process which follows a crystalline plane of the silicon material of first layer 53.

In one embodiment, the etch process is a wet etch and uses a wet anisotropic etchant such as tetra-methyl ammonium hydroxide (TMAH), potassium hydroxide (KOH), or other alkaline etchant. As such, opening 57 is formed with tapered sides as defined by crystalline planes of first layer 53. In one embodiment, the wet anisotropic etch process follows <111> Si planes of first layer 53 such that the sides of opening 57 are oriented at an angle of approximately 54 degrees measured from first side 51. Along first side 51, the width of opening 57 is determined by patterned masking layer 70 which acts as an etch stop.

The wet anisotropic etchant used to etch opening 57 etches through the silicon of first layer 53 from first side 51 toward third layer 55. Third layer 55, however, is resistant to the wet anisotropic etchant and acts as an etch stop preventing further etching of substrate 20. Thus, etching is stopped by third layer 55 as an etch stop layer.

Figure 4F:
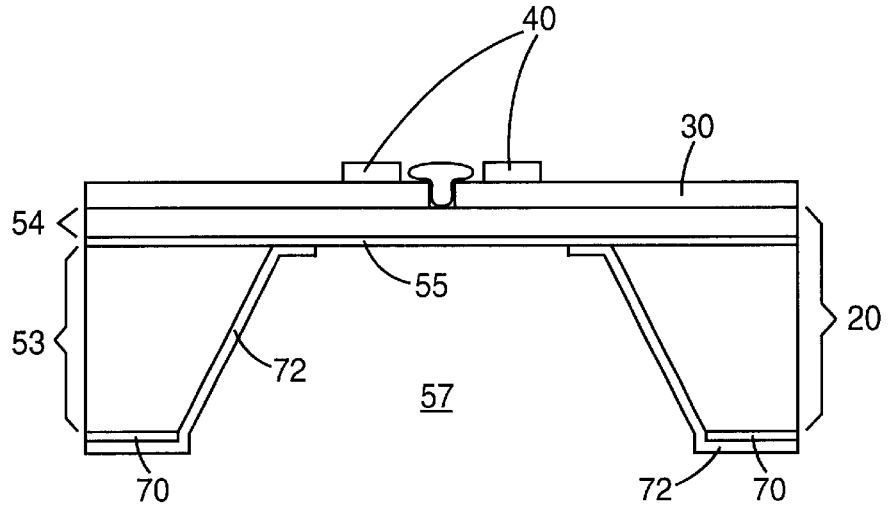

As illustrated in the embodiment of FIG. 4F, after opening 57 is formed through first layer 53 to third layer 55, a masking layer 72 is formed on substrate 20. More specifically, masking layer 72 is formed over masking layer 70 formed along first side 51, within opening 57 in first layer 53, and along third layer 55 exposed through opening 57. As such, masking layer 72 is patterned to define where third layer 55 and second layer 54 are to be etched to form fluid cavity 22 (FIG. 3A). As such, masking layer 72 is used to selectively control or block etching of third layer 55 and second layer 54.

In one embodiment, masking layer 72 is formed by photoresist material which is resistant to etchant used for etching of third layer 55 and second layer 54, as described below. As such, the photoresist material is deposited through opening 57 and patterned to define an exposed portion of third layer 55 through opening 57 and outline a hole to be formed through third layer 55 and second layer 54.

Figure 4G:
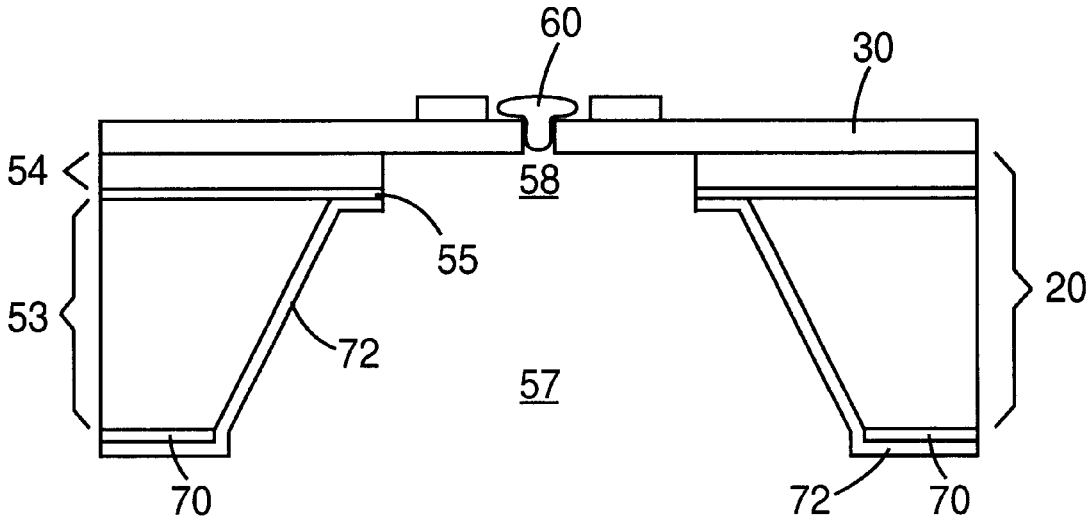

Next, as illustrated in the embodiment of FIG. 4G, a hole 58 is formed in third layer 55 and second layer 54 of substrate 20. More specifically, hole 58 is formed through third layer 55 and through second layer 54 to flexible membrane 30. As such, hole 58 includes a first portion formed through third layer 55 and a second portion formed through second layer 54. Thus, hole 58 communicates with opening 57 in first layer 53 and orifice 32 of flexible membrane 30 (illustrated here as being filled by plug/cap 60). In one embodiment, hole 58 is formed in third layer 55 and second layer 54 by etching third layer 55 and second layer 54 through opening 57 from a base of opening 57 to flexible membrane 30.

Preferably, hole 58 is formed in second layer 54 using an anisotropic etch process which forms hole 58 through second layer 54 with substantially parallel sides. In one embodiment, the etch process is a dry etch such as a plasma based fluorine ($SF_6$) etch. In a particular embodiment, the dry etch is a reactive ion etch (RIE) and, more specifically, a deep RIE (DRIE).

During the deep RIE, an exposed section is alternatively etched with a reactive etching gas and coated until the fluidic channel is formed. In one exemplary embodiment, the reactive etching gas creates a fluorine radical that chemically and/or physically etches the substrate. In this exemplary embodiment, a polymer coating that is selective to the etchant is deposited on inside surfaces of the forming trench, including the sidewalls and bottom. The coating is created by using carbon-fluorine gas that deposits (CF2)n, a Teflon-like material or Teflon-producing monomer, on these channel surfaces. In this embodiment, the polymer substantially prevents etching of the sidewalls during the subsequent etch(es). The gasses for the etchant alternate with the gasses for forming the coating on the inside of the trench.

In one embodiment, the first portion of hole 58 is first formed through third layer 55 using the same dry anisotropic etch process to be used to form hole 58 through second layer 54. In another embodiment, the first portion of hole 58 is first formed through third layer 55 using an isotropic wet etch process such as a buffered oxide etch (BOE). Thus, in both embodiments, after the first portion of hole 58 is formed through third layer 55, the second portion of hole 58 is then formed through second layer 54 to flexible membrane 30 using the dry anisotropic etch process described above. To preserve flexible membrane 30 when etching through second layer 54, etching through second layer 54 is controlled or timed so as to stop at flexible membrane 30 and/or the material of flexible membrane 30 is selected so as to be resistant to the particular etchant used to etch through second layer 54.

Figure 4H:
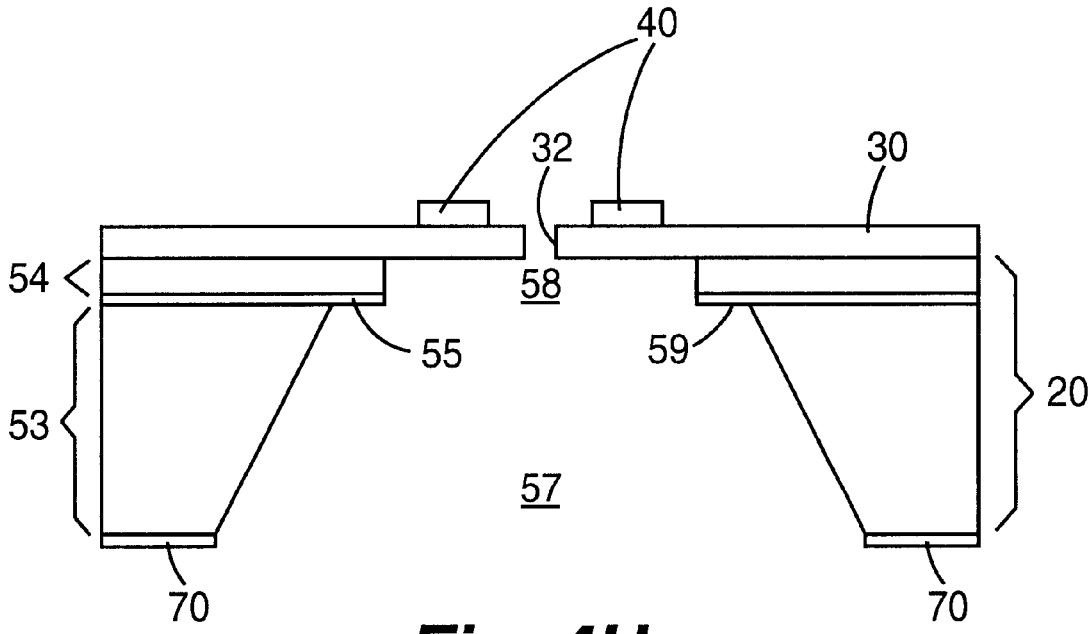

As illustrated in the embodiment of FIG. 4H, after hole 58 is formed through third layer 55 and second layer 54 from opening 57 to flexible membrane 30, masking layer 72 is stripped or removed from substrate 20. In addition, protective cap 60 is removed from orifice 32 and flexible membrane 30. Masking layer 72 and protective cap 60 may be removed by, for example, a resist stripper and a buffered oxide etch (BOE), respectively.

In one embodiment, masking layer 70 is formed as a hard mask and is not substantially removed from substrate 20 during removal of other layers due to resistance of the material selected for the hard mask to the particular etchants used on substrate 20. In addition, in the embodiment shown in FIG. 4H, a dimension of hole 58 is less than a minimum dimension of opening 57. As such, a shelf 59 is formed by third layer 55 between opening 57 and hole 58.

With opening 57 formed through first layer 53 and hole 58 formed through third layer 55 and second layer 54, opening 57 defines fluid plenum 24 and hole 58 defines fluid cavity 22. Thus, by forming substrate 20 with opening 57 and hole 58, multiple, separate fluid feed holes, patterned in the same substrate and feeding individual nozzles or orifices of respective flextensional transducers, can be arranged in an array so as to communicate with a single or common fluid feed plenum.

By interposing third layer 55 as an etch stop layer between first layer 53 and second layer 54, a two-step etching process can be used. In a more specific embodiment, a bulk wet etching process, such as TMAH, can first be used to etch first layer 53 and remove a majority of the silicon, thereby leaving second layer 54 as a thinned silicon bridge or membrane behind flexible membrane 30. As such, a more controllable dry etching process, such as DRIE, can then be used to etch second layer 54 and stop at flexible membrane 30. Thus, by using a silicon dry etch process, such as DRIE, on the thinned silicon membrane formed by second layer 54 from a backside of substrate 20 (i.e., a side opposite of flexible membrane 30), critical dimensions of fluid feed hole or cavity 22, for example, in both mean diameter and shape or location relative to opening 57 and/or orifice 32, are improved compared to using the same dry etch process as a one-step etching process to etch from the backside of substrate 20 all the way to flexible membrane 30.

Figure 5:
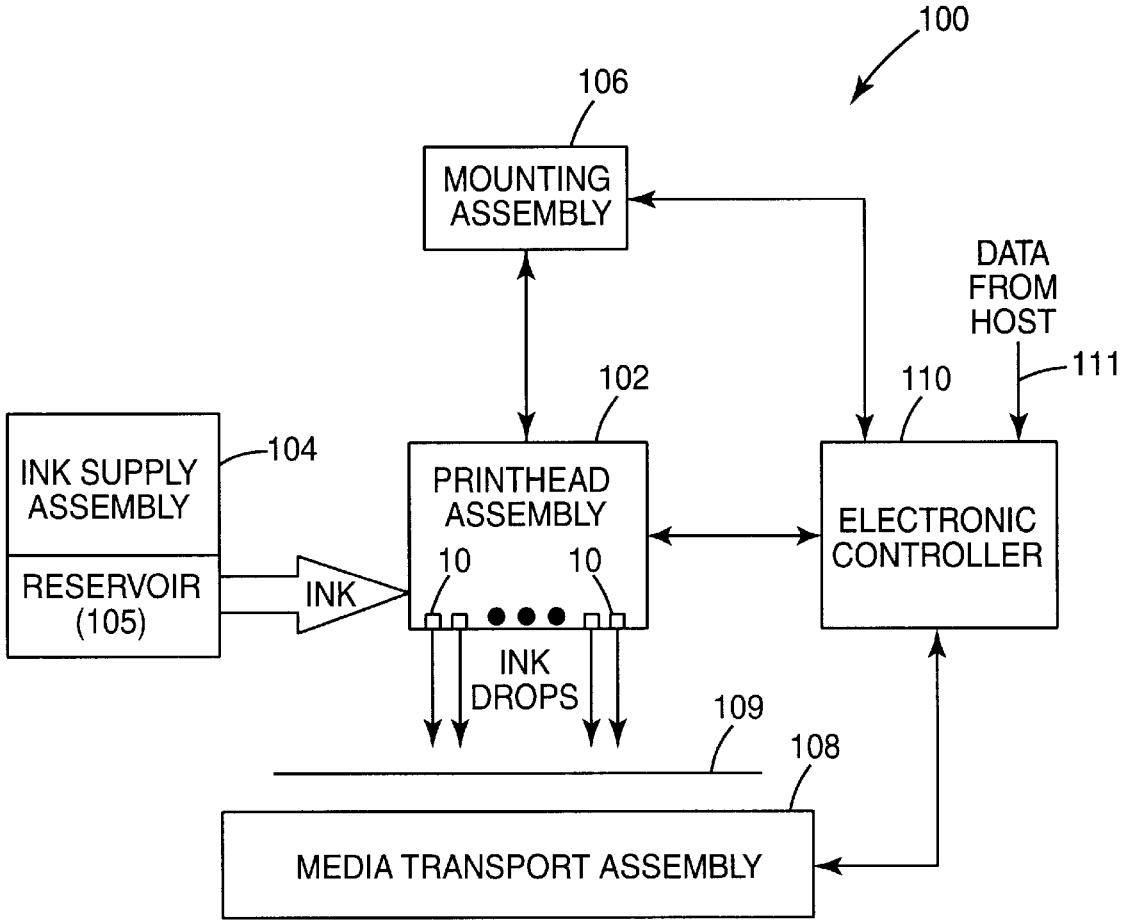
FIG. 5 is a block diagram illustrating one embodiment of an inkjet printing system including a plurality of flextensional transducers according to the present invention.

FIG. 5 illustrates one embodiment of an inkjet printing system 100 according to the present invention. Inkjet printing system 100 includes an inkjet printhead assembly 102, an ink supply assembly 104, a mounting assembly 106, a media transport assembly 108, and an electronic controller 110. Inkjet printhead assembly 102 includes one or more printheads each including a plurality of flextensional transducers 10 which eject drops of ink onto a print medium 109. Print medium 109 is any type of suitable sheet material, such as paper, card stock, transparencies, and the like.

Typically, flextensional transducers 10 are arranged in one or more columns or arrays. As such, properly sequenced ejection of ink from flextensional transducers 10 can cause characters, symbols, and/or other graphics or images to be printed upon print medium 109 as inkjet printhead assembly 102 and print medium 109 are moved relative to each other. In one embodiment, individual flextensional transducers 10 may be provided for ejection of fluids with different properties such as inks of different colors.

Ink supply assembly 104 supplies ink to inkjet printhead assembly 102 and includes a reservoir 105 for storing ink. As such, ink flows from reservoir 105 to inkjet printhead assembly 102 and, more specifically, to fluid reservoir 26 of flextensional transducers 10. In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 105 of ink supply assembly 104 may be removed, replaced, and/or refilled.

Mounting assembly 106 positions inkjet printhead assembly 102 relative to media transport assembly 108 and media transport assembly 108 positions print medium 109 relative to inkjet printhead assembly 102. In one embodiment, inkjet printhead assembly 102 is a scanning type printhead assembly. As such, mounting assembly 106 includes a carriage for moving inkjet printhead assembly 102 relative to media transport assembly 108 to scan print medium 109. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print medium 109 relative to inkjet printhead assembly 102.

Electronic controller 110 communicates with inkjet printhead assembly 102, mounting assembly 106, and media transport assembly 108. Electronic controller 110 receives data 111 from a host system, such as a computer, and includes memory for temporarily storing data 111. Typically, data 111 is sent to inkjet printing system 100 along an electronic, infrared, optical or other information transfer path. Data 111 represents, for example, a document and/or file to be printed. As such, data 111 forms a print job for inkjet printing system 100 and includes one or more print job commands and/or command parameters.

In one embodiment, electronic controller 110 provides control of inkjet printhead assembly 102 including timing control for ejection of ink drops from flextensional transducers 10. As such, electronic controller 110 defines a pattern of ejected ink drops which form characters, symbols, and/or other graphics or images on print medium 109.

Timing control and, therefore, the pattern of ejected ink drops, is determined by the print job commands and/or command parameters.

While the above description refers to inclusion of flextensional transducers 10 in an inkjet printing system 100, it is understood that flextensional transducers 10 may be incorporated into other fluid ejection systems including non-printing applications or systems such as a medical nebulizer. In addition, while the above description refers to ejection of fluid or ink from flextensional transducers 10, it is understood that any flowable material, including a liquid such as photoresist or flowable particles such as talcum powder or a powdered drug, may be ejected from flextensional transducers 10.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A flextensional transducer, comprising:

a substrate including an etch stop layer interposed between a first layer and a second layer;

a flexible membrane supported by the second layer of the substrate and having an orifice defined therein; and an actuator provided on the flexible membrane and adapted to deflect the flexible membrane, wherein the substrate has an opening formed through the first layer and a hole formed through the etch stop layer and the second layer, wherein the hole through the etch stop layer and the second layer of the substrate communicates with the opening through the first layer of the substrate and the orifice in the flexible membrane.

2. The flextensional transducer of claim 1, wherein the first layer and the second layer of the substrate are formed of silicon and the etch stop layer of the substrate includes at least one of an oxide layer and a doped layer.

3. The flextensional transducer of claim 1, wherein the opening through the first layer of the substrate is wet etched.

4. The flextensional transducer of claim 3, wherein the hole through the etch stop layer and the second layer of the substrate is dry etched.

5. The flextensional transducer of claim 3, wherein the hole through the etch stop layer and the second layer of the substrate is deep reactive ion etched.

6. The flextensional transducer of claim 1, wherein the hole through the etch stop layer and the second layer of the substrate is formed through the opening in the first layer of the substrate.

7. The flextensional transducer of claim 1, wherein a thickness of the first layer of the substrate is greater than a thickness of the second layer of the substrate.

8. The flextensional transducer of claim 1, wherein the opening through the first layer of the substrate has tapered sides.

9. The flextensional transducer of claim 8, wherein the hole through the etch stop layer and the second layer of the substrate has substantially parallel sides.

10. The flextensional transducer of claim 1, wherein the actuator is symmetric with the orifice in the flexible membrane.

11. The flextensional transducer of claim 10, wherein the actuator is positioned on the flexible membrane opposite the hole through the etch stop layer and the second layer of the substrate.

12. The flextensional transducer of claim 1, wherein the substrate has a plurality of holes formed through the etch stop layer and the second layer, wherein each of the holes communicate with the opening through the first layer.

13. A method of forming a flextensional transducer, the method comprising:

forming a flexible membrane with an orifice therein on a second layer of a substrate, wherein the substrate includes an etch stop layer interposed between a first layer and the second layer;

forming an actuator over the flexible membrane, wherein the actuator is adapted to deflect the flexible membrane;

etching through the first layer of the substrate to the etch stop layer of the substrate, including forming an opening through the first layer; and etching through the etch stop layer and the second layer of the substrate from the opening through the first layer of the substrate to the flexible membrane, including forming a hole through the etch stop layer and the second layer and communicating the hole with the opening through the first layer and the orifice of the flexible membrane.

14. The method of claim 13, wherein the first layer and the second layer of the substrate are formed of silicon and the etch stop layer of the substrate includes at least one of an oxide layer and a doped layer.

15. The method of claim 13, wherein etching through the first layer of the substrate includes wet etching through the first layer of the substrate, and wherein etching through the etch stop layer and the second layer of the substrate includes dry etching through the second layer of the substrate.

16. The method of claim 15, wherein dry etching through the second layer of the substrate includes deep reactive ion etching through the second layer of the substrate.

17. The method of claim 13, wherein etching through the first layer of the substrate includes selectively masking the first layer of the substrate and outlining the opening through the first layer on the first layer of the substrate.

18. The method of claim 13, wherein etching through the etch stop layer and the second layer of the substrate includes selectively masking within the opening through the first layer of the substrate and outlining the hole through the etch stop layer and the second layer on the etch stop layer of the substrate.

19. The method of claim 13, further comprising:

protecting the orifice of the flexible membrane before etching through the first layer of the substrate; and removing protection from the orifice of the flexible membrane after etching through the etch stop layer and the second layer of the substrate.

20. The method of claim 13, wherein a thickness of the first layer of the substrate is greater than a thickness of the second layer of the substrate.

21. The method of claim 13, wherein a rate of etching through the first layer of the substrate is greater than a rate of etching through the second layer of the substrate.

22. The method of claim 13, wherein etching through the first layer of the substrate includes forming the opening through the first layer of the substrate with tapered sides.

23. The method of claim 22, wherein etching through the etch stop layer and the second layer of the substrate includes forming the hole through the second layer of the substrate with substantially parallel sides.

24. The method of claim 13, wherein forming the actuator over the flexible membrane includes positioning the actuator symmetric with the orifice of the flexible membrane.

25. The method of claim 24, wherein forming the actuator over the flexible membrane further includes positioning the actuator over the flexible membrane opposite the hole formed through the etch stop layer and the second layer of the substrate.

26. The method of claim 13, wherein etching through the etch stop layer and the second layer of the substrate includes etching through a plurality of portions of the etch stop layer and the second layer of the substrate, including forming a plurality of holes through the etch stop layer and the second layer of the substrate and communicating each of the holes with the opening through the first layer.

27. A fluid ejection device, comprising:

a substrate including a third layer interposed between a first layer and a second layer;

a plurality of flexible membrane portions each supported by the second layer of the substrate and having an orifice defined therein; and a plurality of actuators each provided on a respective one of the flexible membrane portions and adapted to deflect the respective one of the flexible membrane portions, wherein the substrate has a fluid feed plenum formed in the first layer and a plurality of fluid feed holes each formed in the third layer and the second layer, wherein each of the fluid feed holes communicates with the fluid feed plenum and the orifice of one of the flexible membrane portions.

28. The fluid ejection device of claim 27, wherein the first layer and the second layer of the substrate are formed of silicon and the third layer of the substrate includes at least one of an oxide layer and a doped layer.

29. The fluid ejection device of claim 27, wherein the fluid feed plenum formed in the first layer of the substrate is anisotropically wet etched in the first layer, and wherein each of the fluid feed holes formed in the third layer and the second layer of the substrate are anisotropically dry etched through the second layer.

30. The fluid ejection device of claim 27, wherein each of the fluid feed holes formed in the third layer and the second layer of the substrate are formed through the fluid feed plenum formed in the first layer of the substrate.

31. The fluid ejection device of claim 27, wherein a thickness of the first layer of the substrate is greater than a thickness of the second layer of the substrate.

32. The fluid ejection device of claim 27, wherein the fluid feed plenum formed in the first layer of the substrate has tapered sides.

33. The fluid ejection device of claim 32, wherein each of the fluid feed holes formed in the third layer and the second layer of the substrate have substantially parallel sides through the second layer.

34. The fluid ejection device of claim 27, wherein each of the actuators are symmetric with the orifice in the respective one of the flexible membrane portions.

35. The fluid ejection device of claim 34, wherein each of the actuators are positioned opposite one of the fluid feed holes formed in the third layer and the second layer of the substrate.

* * * * *